United States Patent [19]

Schol et al.

[11] 3,978,563

[45] Sept. 7, 1976

[54] METHOD OF MANUFACTURING AN ELECTRIC DISCHARGE TUBE HAVING AN OXIDE CATHODE

[75] Inventors: Klaas Schol; Johannes Maria Azalina Antonius Compen; Reinier Maria van den Heuvel, all of Eindhoven, Netherlands

[73] Assignee: U.S. Philips Corporation, New York, N.Y.

[22] Filed: Nov. 26, 1974

[21] Appl. No.: 527,242

[30] Foreign Application Priority Data

Dec. 4, 1973 Netherlands ..... 7316554
Oct. 11, 1974 Netherlands ..... 7413378

[52] U.S. Cl. ..... 29/25.17; 316/17
[51] Int. Cl.[2] ..... H01J 9/12
[58] Field of Search ..... 29/25.17; 117/223, 224; 316/19, 17

[56] References Cited

UNITED STATES PATENTS

| | | | |
|---|---|---|---|
| 2,223,977 | 12/1940 | Wamsley | 117/223 |
| 2,552,654 | 5/1951 | Swanson | 252/521 |
| 2,683,837 | 7/1954 | Hager | 316/19 |
| 2,708,726 | 5/1955 | Atherton | 316/19 X |
| 2,895,854 | 7/1959 | Rocque | 117/223 |
| 2,985,548 | 5/1961 | Blickwedel et al. | 117/223 X |
| 3,148,056 | 9/1964 | Brodie et al. | 29/25.17 |
| 3,625,759 | 12/1971 | Williams | 117/224 |

*Primary Examiner*—Roy Lake
*Assistant Examiner*—Craig R. Feinberg
*Attorney, Agent, or Firm*—Frank R. Trifari; George B. Berka

[57] ABSTRACT

A method of manufacturing an electric discharge tube having an oxide cathode, wherein a suspension is made containing a carbonate mixture, a solution of nitrocellulose as a first binder and a second binder selected from the group of polyimides, highly molecular acrylate resins, and nylon types, a cathode support is coated with the suspension and dried, whereupon the cathode is mounted in the tube and, upon evacuation of the tube, is activated at 1200°C.

7 Claims, 2 Drawing Figures

METHOD OF MANUFACTURING AN ELECTRIC DISCHARGE TUBE HAVING AN OXIDE CATHODE

Figure 1:
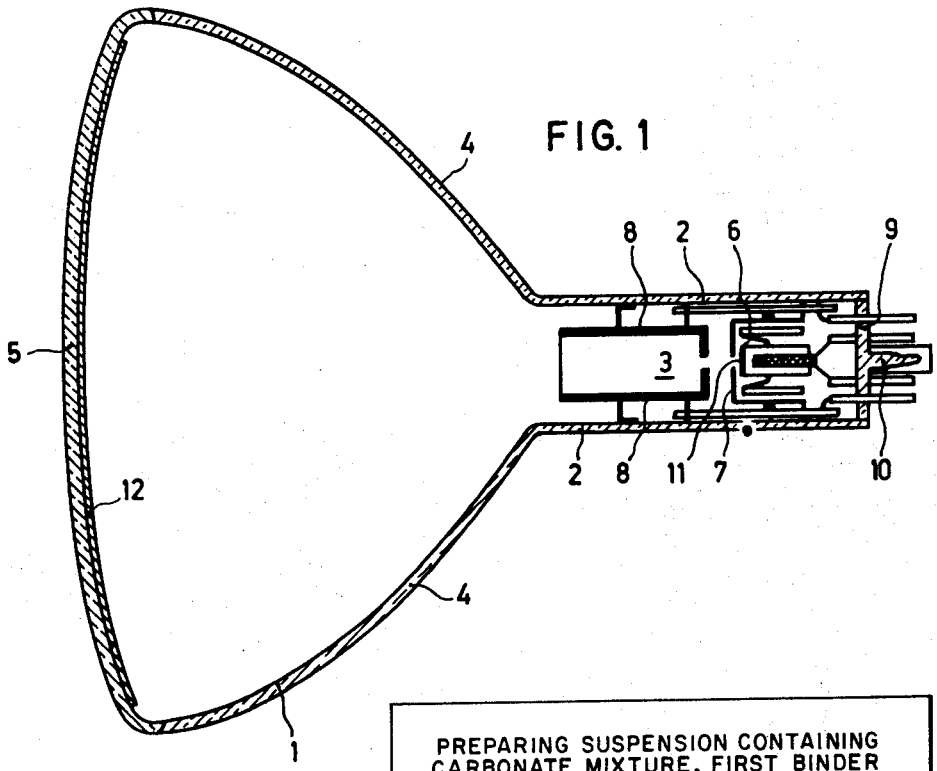

The invention relates to a method of manufacturing an electric discharge tube in which an oxide cathode is provided in an envelope, which oxide cathode which a support on which a coating comprising a mixture of one or more carbonates is provided by means of a binder, which binder consists of a solution of a first and a second binder, which second binder is resistant at temperatures below 450°C for at least a few minutes and has a higher temperature resistance than the first binder.

The invention furthermore relates to an electric discharge tube manufactured by means of this method.

In manufacturing electric discharge tubes it has been found that the said coating of the oxide cathode consisting of an emissive layer comprising one or more carbonates is damaged in many cases. This is the case in particular when said coating is porous. It has been found that a smooth emissive layer consisting of very finely ground particles is less subject to such damages but also has more unfavorable emission properties. The damage is ascribed to the fact that the cathode, during sealing the support in the wall of the envelope, can obtain a temperature of approximately 300° to 450°C for a few minutes. The first binder which usually consists of nitrocellulose decomposes at least partly and the cathode becomes extremely vulnerable. It has therefore been suggested in the U.S. Pat. No. 2,683,831 to mix the first binder, which consists of nitrocellulose, with a second binder, a synthetic resin such as a mixture of a condensation product of phenol and furfural, which is resistant at the said temperatures of 400° to 500°C when the heating does not last too long. Said synthetic resin takes over the action of the binder when the nitrocellulose decomposes. The synthetic resin decomposes at a much higher temperature and disappears substantially without leaving residues upon activating the oxide cathode at a temperature of approximately 1200°C.

A drawback of the method as described in the above mentioned patent is that in particular in the case of envelopes having a capacity of more than 2 liters, for example television display tubes, the cathode coating nevertheless shows damages.

Another drawback is that the mixture of binders and carbonates used is poorly stable and has no constant viscosity and has therefore to be prepared every day again, which is expensive.

It is the object of the invention to provide a method of manufacturing an electric discharge tube having an oxide cathode, in which the oxide cathode is still quite undamaged after evacuating the envelope.

Another object of the invention is to provide a method in which the mixture of binders is readily stable and can easily be processed (substantially constant viscosity).

The method according to the invention is characterized in that the second binder contains at least one substance from the group of polyimides, highly molecular arcylate resins and nylon types.

The invention is based on the recognition that during the evacuation of the discharge tube, in which the air which is sucked off brushes along the cathode, droplets of water are formed as a result of condensation in the more or less moist air. Said droplets of water collide at high velocity against the cathode and can thus destroy parts of the cathode coating. This phenomenon occurs in particular in the manufacture of cathode ray tubes in which the exhaust tube through which the tube is evacuated is present at the end of the neck.

By using the method, a cathode coating is obtained which, during the manufacture of the electric discharge tube until same is evacuated, remains sufficiently hard even at a heating up to 450°C for not too long a period of time, and is hence less rapidly damaged.

So the invention is not restricted to a special resinous material having a sufficiently great hardness as a second binder. According to the invention it has been found that one or more substances belonging to the polyimides and nylon types also give good satisfaction. When using the said substances in the method, a low reject percentage in manufacturing electric discharge tubes occurs.

Finally it has been found that the said second binders have a favourable influence on the emission of the oxide cathode immediately after activation.

Although it has been suggested in the U.S. Pat. Spec. No. 2,552,654 to delay the decomposition of the nitrocellulose during the sealing of the support of the oxide cathode by the addition of high-boiling-point materials, such as triethylene-glycol-di-2-ethylbutyrate, in the manufacture according to said method damages of the cathode coating prove to occur nevertheless due to the bombardment with droplets of water.

A rigid coating of the support of the oxide cathode is obtained when a solution of the second binder is mixed with the said mixture of one or more carbonates and is then suspended in a solution of the first binder, after which the said coating is formed from the formed suspension. The suspension formed in this manner is readily stable and can be readily processed.

A readily stable suspension can also be obtained when a solution of the second binder is mixed with a solution of the first binder in which the mixture of one or more carbonates is then suspended.

When the mixture of one or more carbonates is mixed with a solution of the second binder and is filtered off, then dried and suspended in a solution of the first binder, a suspension is obtained which is particularly suitable to obtain a homogeneous coating of the oxide cathode which will not easily be damaged. In this embodiment of the method, carbonate grains which are surrounded with a layer of second binder are obtained after drying.

A fourth embodiment of the method is that in which the said mixture of one or more carbonates is suspended in a solution of the first binder after which at least one layer is formed from the formed suspension and at least one layer is also formed from a solution of the second binder, which layers are provided one on top of the other and together constitute the said coating. When the layers are only just formed, they will merge into each other so that a rigid and homogeneous layer structure is obtained. One layer of second binder may also be provided, for example, over several layers of carbonate suspension.

As is known, oxide cathodes having coiled filaments as supports are obtained by dipping said filaments in a suspension. In this manner, directly heated cathodes are formed. A much better performance of the method is to provide the coating on the support, especially in indirectly heated oxide cathodes, by spraying the suspension on it.

When the formed coating is then dried at approximately 300°C and hardened, the cathodes are already less vulnerable outside the envelope.

Oxide cathodes manufactured according to the method of the invention are particularly suitable for electric discharge tubes having a capacity exceeding 2 liters, as is the case, for example, in cathode ray tubes and television display tubes. In these tubes, actually, most droplets of water will be formed during evacuation and the possibility of damage is greatest.

The invention will now be described in greater detail with reference to a number of examples of the method and in conjunction with a drawing.

Figure 2:
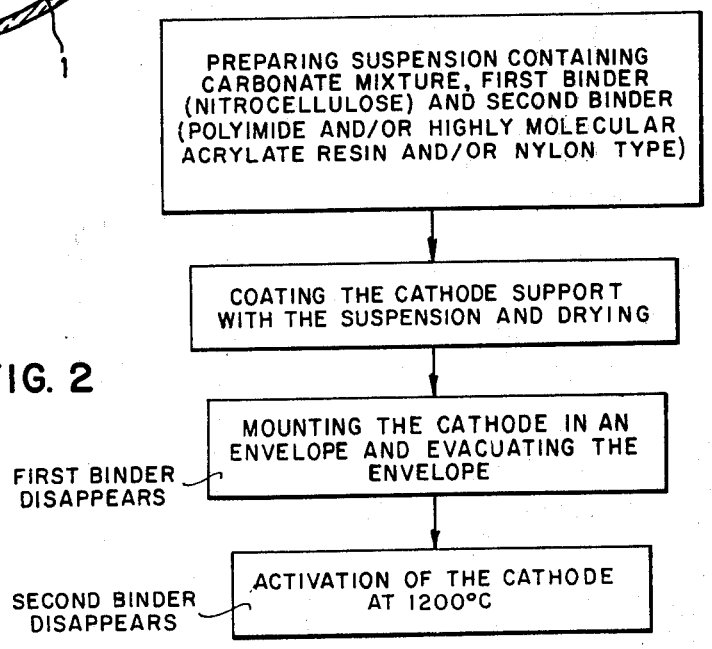

FIG. 1 is a sectional view of a CRT manufactured according to the method of this invention, and FIG. 2 is a flow diagram of the process.

EXAMPLES

In all the examples the first binder is formed by a solution of:

60 Grams of nitrocellulose in 1700 mls of diethylcarbonate and 300 mls of diethyloxalate.

EXAMPLE 1

2 Grams of poly(bis)malein-imide (for example kerimid 601, poly-imide powder of Rohne Poulenc) are added to 110 grams of Ba-Sr-carbonate powder and thoroughly mixed by means of a mortar. This mixture is suspended in 200 mls of first binder solution (see above) by means of a vigorous stirrer. Cathode support surfaces are sprayed with the formed suspension until a coating having a thickness of 65$\mu$ and a weight per unit by volume of 0.75 gr/ccm has been obtained. The sprayed cathodes are then dried and hardened at approximately 300°C for 1 min. prior to assembly in the electric discharge tube.

EXAMPLE 2

110 Grams of Ba-Sr-carbonate powder are stirred in 400 cc, being a 5% by weight solution of poly-pyromellite-imide (for example, RC 5044 of Dupont in n-methyl-2-pyrrolidon). After stirring for five minutes the carbonate powder is filtered off and dried in air at 80°C. The dried powder is then suspended in 200 cc of binder solution. The further processing is carried out as described in Example 1.

EXAMPLE 3

550 Grams of Ba-Sr-carbonate powder are suspended in 1000 cc of binder solution. With vigorous stirring, 80 grams of solution, being 3.1% by weight of highly molecular acrylate resin (for example polymethylmethacrylate) in ethyl acetate are added to said suspension. From the resulting suspension is formed a cathode coating as is described in Example 1.

EXAMPLE 4

550 Grams of Ba-Sr-carbonate powder are suspended in 1000 ml of binder solution. During the provision of said suspension on the supporting surface of the oxide cathode in 11 spray layers, a spray layer consisting of a 5% by weight aromatic polyamide (nylon type, for example, Trogamidt of Dinamite Nobel) solution in n-methyl-2-pyrrolydon is provided by means of a second spraying device between the fifth and sixth spray layer and over the 11th spray layer. The whole is then dried and hardened in a manner analogous to that described in the preceding methods.

FIG. 1 is a longitudinal cross-sectional view through an electric discharge tube manufactured according to the method.

The envelope 1 consists of a neck 2 in which the electron gun 3 is mounted, a conical part 4 and a display screen 5 which is coated on the inside with a phosphor layer 12. The electron gun 3 is composed of an indirectly heated cathode 6, a control electrode 7 and an anode 8 and is mounted on a bottom portion 9. The bottom portion 9 is connected to the neck 2 by means of sealing or welding with pressure and the like, during which the electron gun 3 is heated 9300°–450°C). The coating 11 of the cathode 6 may partly decompose so that the carbonate particles present therein shown a poor coherence and the coating can thus easily be damaged. In order to prevent this, according to the known method a second binder having a resistance below 450°C and a larger temperature resistance than the first binder was added to the carbonate layer. The bottom portion 9 comprises an exhaust tube 10 through which the envelope is evacuated. In particular when the envelope 1 is larger than 2 liters, droplets of water are formed which are drawn along with the air flow towards the exhaust tube 10. Said droplets of water are formed by condensation as a result of cooling by expansion of the air during the evacuation. Since an aperture of a small dimension only is present between the control electrode 7 and the anode 8 and the wall of the neck 2, the air, on its way to the exhaust tube, passes for the greater part through the apertures of the electron gun and so do consequently the droplets of water. As a result of this they move in the direction of the cathode coating (coating 11) of which they destroy parts. By using the method according to the invention this is prevented and considerably harder cathode coatings are obtained.

After evacuating the envelope 1, the cathode is activated at a temperature of approximately 1200°C, the carbonates being converted into oxides and the second binder disappearing substantially without leaving residues. Since the prosity of the carbonate layer is maintained both during the sealing of the bottom portion 9 and during the evacuation of the envelope 1, in spite of the heating to 300° to 450°C and the action of the droplets of water, the decomposition of the carbonates is not restricted afterwards and the cathode emission is good from the beginning.

Besides for the usual oxide cathode, the invention is also of importance for cylindrical oxide cathodes in which the emissive surface is present on a cylinder wall, for tubes having a comparatively large volume, for example, transmitter tubes. The invention is of particularly great importance for color television display tubes in which three cathodes are used and the possibility of damage is hence also approximately three times as large. Damage of one of the cathodes in such a tube makes same useless.

Although in the present method only a number of steps has been described, namely the preparation of a suitable suspension in various manners from various materials and the provision thereof on a cathode support as a result of which a coating is obtained in various manners, which cathode support is provided in the envelope, it will be obvious to those skilled in the art that the uses of the invention not explained with reference to an example nevertheless fall within the scope of the present invention. For example, a polyimide instead of an aromatic polyamide (nylon type) may also be used in Example 4.

What is claimed is:

1. A method of manufacturing an electric discharge tube having an envelope of a volume of at least 2 liters, and an oxide cathode, comprising the steps of: preparing a suspension containing a mixture of carbonates; a first binder including nitrocellulose; a second binder including at least one substance selected from the group consisting of polyimides, highly molecular acrylic resins and nylon types, said second binder having a higher resistance than said first binder to withstand impacts of water droplets and resist temperatures up to 450°C for at least a few minutes; coating a cathode support with said suspension, drying the coating at a temperature below 450°C; mounting the cathode in said envelope and evacuating said envelope; and activating the cathode at a temperature above 450°C to convert the carbonates into oxides.

2. A method as claimed in claim 1,wherein a solution of the said second binder is mixed with the said mixture of carbonates and is then suspended in a solution of the first binder.

3. A method as claimed in claim 1, wherein a solution of the second binder is mixed with a solution of the first binder in which the mixture of carbonates is then suspended.

4. A method as claimed in claim 1, wherein the mixture of carbonates is mixed with a solution of the said second binder and is filtered off, then dried and suspended in a solution of the first binder.

5. A method as claimed in claim 1, wherein the said mixture of carbonates is suspended in a solution of the first binder after which at least one layer is formed from the formed suspension and at least one layer is also formed from a solution of the second binder, which layers are provided one on top of the other and together constitute the said coating.

6. A method as claimed in claim 1, wherein the said coating is formed by spraying.

7. A method as claimed in claim 6, wherein after the spraying, the coating is dried and hardened at a temperature of approximately 300°C for approximately 1 minute.

* * * * *

UNITED STATES PATENT AND TRADEMARK OFFICE

CERTIFICATE OF CORRECTION

PATENT NO. : 3,978,563

DATED : September 7, 1976

INVENTOR(S) : KLAAS SCHOL ET AL

It is certified that error appears in the above-identified patent and that said Letters Patent are hereby corrected as shown below:

Col. 4, line 12, "9300°-450°C)" should be --(300°-450°C)--

Signed and Sealed this

Thirtieth Day of November 1976

[SEAL]

*Attest:*

RUTH C. MASON
*Attesting Officer*

C. MARSHALL DANN
*Commissioner of Patents and Trademarks*